US012606993B2

(12) United States Patent
Kean et al.

(10) Patent No.: US 12,606,993 B2
(45) Date of Patent: Apr. 21, 2026

(54) DETERMINATION OF AN EXCAVATOR SWING BOOM ANGLE BASED ON INTERMITTENT FIRST INTERIM SWING BOOM ANGLES

(71) Applicant: LEICA GEOSYSTEMS TECHNOLOGY A/S, Odense SØ (DK)

(72) Inventors: Michael Goulet Kean, Odense SØ (DK); Tommi Juhani Kauppinen, Odense C (DK)

(73) Assignee: LEICA GEOSYSTEMS TECHNOLOGY A/S, Odense SØ (DK)

( * ) Notice: Subject to any disclaimer, the term of this patent is extended or adjusted under 35 U.S.C. 154(b) by 197 days.

(21) Appl. No.: 18/212,389

(22) Filed: Jun. 21, 2023

(65) Prior Publication Data

US 2023/0417026 A1 Dec. 28, 2023

(30) Foreign Application Priority Data

Jun. 22, 2022 (EP) ..... 22180536

(51) Int. Cl.
*E02F 9/26* (2006.01)
*E02F 3/43* (2006.01)

(52) U.S. Cl.
CPC ..... *E02F 9/265* (2013.01); *E02F 3/437* (2013.01)

(58) Field of Classification Search
CPC . E02F 9/265; E02F 9/264; E02F 3/437; E02F 3/435; E02F 3/325; E02F 3/384;
(Continued)

(56) References Cited

U.S. PATENT DOCUMENTS 5,848,485 A * 12/1998 Anderson ..... E02F 3/435 701/50
5,907,111 A * 5/1999 Josten ..... E02F 9/264 73/866.5

(Continued)

FOREIGN PATENT DOCUMENTS

CN 215290408 U 12/2021
DK 180402 B1 4/2021

(Continued)

OTHER PUBLICATIONS

"Swing." Merriam-Webster.com Dictionary, Merriam-Webster, https://www.merriam-webster.com/dictionary/swing. Accessed Oct. 20, 2021, pp. 1-8.*

(Continued)

*Primary Examiner* — Andrew R Dyer
(74) *Attorney, Agent, or Firm* — Maschoff Brennan

(57) ABSTRACT

A system for determining a swing boom angle of an excavator. The system comprises a first measuring sensor configured to be mounted on a vehicle frame or a swing boom 4, wherein the first measuring sensor is configured to determine a first interim swing boom angle of the swing boom relative to the vehicle frame. The first interim swing boom angle is one of a discrete amount of one or more intermittent first interim swing boom angles, each of the discrete amount of one or more intermittent first interim swing boom angles being spaced from each other by at least a value of one degree. A second measuring sensor mounted on the swing boom to determine a second interim swing boom angle of the swing boom relative to the vehicle frame, the second interim swing boom angle being from an indiscrete angle range and a processing unit.

18 Claims, 10 Drawing Sheets

(58) Field of Classification Search
CPC . E02F 3/301; E02F 3/303; E02F 3/307; E02F 3/32; E02F 3/386; G01B 7/30; G01B 11/26; G06F 17/10
USPC ..... 701/50
See application file for complete search history.

(56) References Cited

U.S. PATENT DOCUMENTS

| | | | | |
|---|---|---|---|---|
| 6,226,902 | B1 | 5/2001 | Heyne | |
| 7,650,252 | B2 | 1/2010 | Douglas | |
| 12,111,185 | B2 * | 10/2024 | Dupre | G01D 5/145 |
| 2016/0362872 | A1 | 12/2016 | Kumamoto et al. | |
| 2017/0254049 | A1 * | 9/2017 | Kean | E02F 3/3604 |
| 2018/0373966 | A1 | 12/2018 | Beschorner et al. | |
| 2020/0002914 | A1 * | 1/2020 | Yoshida | E02F 3/32 |
| 2020/0018037 | A1 * | 1/2020 | Nakamura | E02F 3/43 |
| 2021/0047153 | A1 * | 2/2021 | Mizuki | B66C 23/42 |
| 2021/0215483 | A1 | 7/2021 | Krone et al. | |
| 2022/0025608 | A1 * | 1/2022 | Itoh | E02F 9/2282 |
| 2022/0267999 | A1 * | 8/2022 | Hartvig Andersen | E02F 3/435 |
| 2023/0018606 | A1 * | 1/2023 | Kalantar | E02F 9/264 |
| 2023/0265640 | A1 * | 8/2023 | Wright | E02F 9/2253 701/50 |

FOREIGN PATENT DOCUMENTS

| | | | |
|---|---|---|---|
| DK | 201900955 | A1 | 4/2021 |
| EP | 3 409 841 | A1 | 12/2018 |
| WO | 95/34849 | A1 | 12/1995 |
| WO | 2021028002 | A1 | 2/2021 |
| WO | 2022/008361 | A2 | 1/2022 |

OTHER PUBLICATIONS

David Johnson, What is a Swing Boom on a Mini Excavator? Complete Guide, AHMCorp.com, Jan. 21, 2025, pp. 1-15.*
What Is a Swing Boom on a Mini Excavator?, boleous.com, Apr. 15, 2025, pp. 1-7.*
Extended European Search Report dated Jan. 9, 2023 as received in Application No. 22180536.9.

* cited by examiner

DETERMINATION OF AN EXCAVATOR SWING BOOM ANGLE BASED ON INTERMITTENT FIRST INTERIM SWING BOOM ANGLES

FIELD OF THE DISCLOSURE

The present disclosure relates to a system for determining a swing boom angle of an excavator, wherein the excavator comprises a vehicle frame comprising a cabin and a swing boom arranged on the vehicle frame and configured to be rotated relative to the vehicle frame about a rotation axis that an actual swing boom position defines a swing boom angle.

BACKGROUND

Large scale excavators are earth moving machines that consist of a lower part that rests on the ground and supports tracks or wheels to move the excavator, a rotating upper part mounted to the lower part by means of a large bearing with a vertical axis of rotation and a dig structure that is composed of several components attached to each other and the rotating upper part by means of linkage pins with horizontal axes of rotation that are parallel to each other.

Miniature excavators are also capable of swinging the dig structure relative to the rotating upper part. There is a pin with a vertical rotation axis in between the dig structure and the rotating upper part. This type of construction is called a swing boom because the boom swings relative to the upper part resulting in a swing boom angle.

Backhoes are earth moving machines that consist of a machine frame supported by wheels attached to a loader dig structure and an excavating dig structure. Both digging structures are composed of several components forming a serial kinematic chain ending in a digging implement. Systems exist to track the motion of these kinematic linkages. However, the excavating dig structure is attached to the vehicle frame with a joint that allows the entire dig structure to rotate about the vertical direction with respect to the vehicle frame.

Typical sensing algorithms rely on integrating gyroscopes to measure displacements in position and measuring gravity with an accelerometer to stabilize the gyroscope integrations and detect the true orientation over long time frames. Over time the integration of the gyroscope measurement will drift due to uncorrected bias and sensor noise. The gravity measurement cannot be used to stabilize the swing boom rotation as the rotational axis is aligned or nearly aligned with gravity and thus the swing boom angle has no impact on how gravity is observed by the accelerometers.

DK180402B1 discloses a wire sensor to measure the length of the cylinder used to actuate a swing boom movement on mini excavators with swing boom functionality. The wire sensor is a self-retracting spool of wire that has an angular encoder mounted to measure rotation of the spool relative to the housing. In this installation, the housing is mounted onto the main upper part of the excavator. The wire is extended and affixed to the swing boom structure. There is a one-to-one correspondence between the measurement of the angular encoder and the swing boom angle with respect to the upper part.

U.S. Pat. No. 7,650,252 B2 discloses a system and a method to sense the inclination of a machine element, such as a platform, and eliminate tangential and radial acceleration errors. The platform defines orthogonal X and Y axes, and is rotatable about a Z axis. An inclinometer, mounted on the platform at a location spaced from the axis of rotation by a distance r, provides inclinometer outputs indicating acceleration in the X and Y directions. A rate gyro on the platform senses the rotational speed of the platform. The rate gyro output is differentiated and multiplied by r to determined tangential acceleration at the inclinometer. A circuit resolves the tangential acceleration into X axis and Y axis components, which are used to correct the inclinometer outputs for errors that would otherwise result from tangential acceleration.

There is a need to develop systems which determine accurately the swing boom angle of excavator without relying on integrating gyroscopes and stabilizing the gyroscope integrations by measuring gravity with an accelerometer. Further, systems are required which provide alternative approaches to track the swing boom angle and do not rely on a wire sensor.

SUMMARY

It is therefore an object of the disclosure to provide an improved system for determining a swing boom angle of an excavator.

The present disclosure relates to a system for determining a swing boom angle of an excavator, wherein the excavator comprises a vehicle frame comprising a cabin and a swing boom arranged on the vehicle frame and configured to be rotated relative to the vehicle frame about a rotation axis that an actual swing boom position defines a swing boom angle. The system comprises a first measuring sensor configured to be mounted on the vehicle frame or the swing boom, wherein the first measuring sensor is configured to determine a first interim swing boom angle of the swing boom relative to the vehicle frame. The first interim swing boom angle is one of a discrete amount of one or more intermittent first interim swing boom angles, each of the discrete amount of one or more intermittent first interim swing boom angles being spaced from each other by at least a value of one degree. The system further comprises a second measuring sensor configured to be mounted on the swing boom and to determine a second interim swing boom angle of the swing boom relative to the vehicle frame, the second interim swing boom angle being from an indiscrete angle range and a processing unit. The processing unit is configured to receive first interim swing boom angle and the second interim swing boom angle and determine the swing boom angle by applying at least one of a filter and an algorithm to the first interim swing boom angle and the second interim swing boom angle.

By way of example, the disclosure relates to a system for bounding the error of a gyroscope-integration based system for tracking swing boom angle. When the gyroscopes are integrated to track an orientation, (long-term) drift is accumulated over time due to a combination of sensor noise, uncorrected sensor bias, and incorrectly integrated machine vibrations, wherein for an accurate measurement of the swing boom angle this long-term drift has to be corrected. The position of the swing boom is determined at a concrete, known position and based on this known swing boom position the first interim swing boom angle can then be determined as one of a discrete amount of one or more intermittent first interim swing boom angles. With the help of this information, the error of the second measuring sensor (for example an IMU) can be corrected.

The first interim swing boom angle is passed to a sensor fusion algorithm along with the second interim swing boom angle (determined by, for example, gyroscope integration). The sensor fusion algorithm could be a complementary filter, a Kalman filter, an iterative root seeking algorithm, or any other suitable algorithm to combine the two measuring sensor readings (first interim swing boom angle and second interim swing boom angle) into a single stable measurement of the swing boom angle.

In other words, momentary sensors (first measuring sensor) serve to provide one or more known positions that can be combined with a continuous measurement (second measuring sensor) that suffers drift. Consider a system that uses gyroscopes to measure the change in the swing boom angle relative to the cab. There is a gyroscope mounted on the cab and one mounted on the swing boom or swing boom casting. If the gyroscope is mounted on the swing boom then it must be resolved into the coordinate frame of the swing boom casting before it can be combined with the cab IMU signal. The relative angular speed $\omega_{Relative}$ is the difference between the swing boom casting rotation rate $\omega_{SwingBoom}$ and the cab rotation rate $\omega_{Cab}$.

$$\omega_{Relative} = \omega_{SwingBoom} - \omega_{Cab}$$

If this relative speed $\omega_{Relative}$ is integrated from the moment the excavator is powered on and throughout its full operation, the relative angle between the cab and the swing boom $\Delta\theta_{SwingBoom}$ can be obtained.

$$\Delta\theta_{SwingBoom} = \int \omega_{Relative} dt$$

The integration provides the change in swing boom angle since power on. To obtain an absolute error the operator has to perform some calibration task. The integration can now be written as a function of the calibration position and time since the last calibration was performed.

$$\theta_{SwingBoom} = \theta_{Calibration} + \int_{t_{Calibration}}^{t_{Current}} \omega_{Relative} dt$$

There is some error in the measurement. It could be due to gyroscope bias, white noise, incorrect projection of the swing boom gyroscopes into the swing boom coordinate frame. But regardless of the source, it can be assumed that there is error in the measured relative angular velocity. The swing boom angle $\theta_{SwingBoom}$ can be updated to include this error.

$$\theta_{SwingBoom} = \theta_{Calibration} + \int_{t_{Calibratio}}^{t_{Current}} \omega_{Relative} dt + \int_{t_{Calibration}}^{t_{Current}} \omega_{Error} dt$$

Over time, the integration of the error will cause drift away from the true swing boom angle $\theta_{SwingBoom}$. If the error rate can be bounded, then an upper time limit can be set that guarantees a known accuracy. The operator must then repeat the calibration task at fixed intervals in order to maintain the desired system accuracy. Every time a calibration task occurs, the position is set to the calibration position, the calibration timestamp is updated, and the integrated error is once again reduced to zero.

Rather than require the operator to perform a calibration task, it is possible to address this compounding error by using a sensor or sensor array as the first measuring sensor. If a single sensor is used, then the error accumulates from one instant when the sensor returns "logical true" (position determination with first measuring sensor) until the next instant. Essentially the swing boom angle becomes self-calibrating. The calibration task is "move the swing boom so the sensor returns 'True'". The frequency of this is related to the machine usage and the placement and number of sensors.

Going one step further, if the angular rate error includes a bias type error then the bias error can be observed using two subsequent calibration events.

$$\theta_{SwingBoom} = \theta_{Calibration,k} + \int_{t_{Calibration,k}}^{t_{Calibration,k+1}} \omega_{Relative} dt + \int_{t_{Calibration,k}}^{t_{Calibration,k+1}} \omega_{Bias} dt + \int_{t_{Calibration,k}}^{t_{Calibration,k+1}} \omega_{Error} dt$$

At the k+1th calibration position, the swing boom position has to be that of the most recent calibration point plus the error.

$$\theta_{SwingBoom} = \theta_{Calibration,k+1} + \epsilon_{SwingBoom}$$

By substitution, the error term can now be calculated using the two known calibration positions and the integrated motion between the calibration timings.

$$\theta_{Calibration,k+1} + \epsilon_{SwingBoom} = \theta_{Calibration,k} + \int_{t_{Calibration,k}}^{t_{Calibration,k+1}} \omega_{Relative} dt + \int_{t_{Calibration,k}}^{t_{Calibration,k+1}} \omega_{Bias} dt + \int_{t_{Calibration,k}}^{t_{Calibration,k+1}} \omega_{Error} dt$$

The integration of the correct relative angular velocity from the kth calibration point to the k+1th integration point will give the correct position.

$$\theta_{Calibration,k} + \int_{t_{Calibration,k}}^{t_{Calibration,k+1}} \omega_{Relative} dt = \theta_{Calibration,k+1}$$

And the error $\epsilon_{SwingBoom}$ can be rewritten as:

$$\epsilon_{SwingBoom} = \omega_{Bias}(t_{Calibration,k+1} - t_{Calibration,k}) + \int_{t_{Calibration,k}}^{t_{Calibration,k+1}} \omega_{Error} dt$$

If it is assumed that the remaining error integration is random and approximately zero mean, the effect of integrating it over small time windows can be neglected. This allows to estimate the bias over the time period between calibration events by substituting back into the relationship between the measured swing angle, the error, and the k+1th calibration position.

$$\omega_{Bias} = \frac{(\theta_{SwingBoom} - \theta_{Calibration,k+1})}{t_{Calibration,k+1} - t_{Calibration,k}}$$

This bias estimate can then be subtracted from the measured relative angular velocity prior to integration, which will result in more accurate measurements between calibration positions. In practice, each interval between calibration points will enable the measurement of an incremental bias. These incremental bias measurements are added to the existing bias estimate to continually refine the bias estimate. This is one example of a fusion scheme, other schemes such as Kalman filters may also be used.

In a further embodiment, the system further comprises a display unit configured to be arranged in the cabin, wherein the display unit is connected to the processing unit. The display unit is configured to provide a visualization of swing boom angle information to the operator based on the swing boom angle.

The visualization of the swing boom angle can be realised in different ways. On the one hand, the specific value of the swing boom angle can be shown as a number on the display. On the other hand, it is also possible to display the swing boom angle by colour coding or on a colour scale. For example, a red colour can be displayed for a swing boom position left (negative angle values) of the middle position (zero degrees), which changes to a blue colour for a swing boom position right (positive angle values) of the middle position. The gradation of the individual angle values can be done by mixing different colours. Also the display via a bar, which increases in length as the value of the swing boom angle increases, is conceivable. It is also possible to display the swing boom angle via a scale on which a needle moves according to the movement of the swing boom (comparable to a compass) and thus displays the corresponding swing boom angle. Other embodiments for visualization of the swing boom angle information are also conceivable.

In a further embodiment, the system further comprises a counterpart intended for detection by the first measuring sensor, wherein the counterpart is configured to be mounted on the swing boom and to move along with the swing movement of the swing boom if the first measuring sensor is mounted on the vehicle frame or the counterpart is configured to be mounted on the vehicle frame at a known position if the first measuring sensor is mounted on the swing boom to move along with the swing movement of the swing boom.

In order to aid a gyroscope integrated measurement of the swing boom angle on backhoes and mini excavators supplemental sensors can be mounted on the structure. Passive elements can be placed on the swing boom lever structure so that they move relative to the vehicle frame when the swing boom rotates. An active element (first measuring sensor) can then be placed on the machine frame in order to measure the position or motion of the passive elements.

In a further embodiment, the first measuring sensor is at least one hall effect sensor and the counterpart is at least one magnet, in particular at least one permanent magnet or at least one electro magnet.

By way of example, a permanent magnet is added on the swing boom lever and a hall effect sensor on the vehicle frame. During swing boom rotation about the rotation axis, the magnet will rotate with the swing boom structure. If the magnet is placed so that it is aligned with the hall effect sensor's measurement window in the centered position and is close enough for the hall effect sensor to read the magnetic field, then the hall effect sensor will generate a momentary signal when the swing boom is in the centered position. This can be used to reset the gyroscope integration at a known position.

Several magnets may be used with a single hall effect sensor if logic is included to determine contextually which magnet is being sensed by the hall effect sensor. A single magnet may be used with multiple hall effect sensors to trigger a reset at various positions of the swing boom. A combination of several hall effect sensors and several sensors can be used to encode several linkage positions—for instance all three hall effect sensors is centered, left and center hall effect sensor is a midposition displaced to the right, and only the left sensor would be full right swing with right and center hall effect sensors indicating a midposition displaced to the left and only the right hall effect sensor indicating a full left displacement.

In a further embodiment, the first measuring sensor is at least one induction sensor and the counterpart is at least one metal structure.

In a further embodiment, the first measuring sensor is at least one light emitting and sensing system and the counterpart is at least one reflector, in particular at least one mirror.

In a further embodiment, the first measuring sensor is at least one momentary switch and the counterpart is at least one metal structure, wherein the at least one metal structure physically contacts the at least one switch and triggers the at least one switch.

In a further embodiment, the first measuring sensor is at least one visual sensor configured to detect colors and the counterpart is a color gradient.

In a further embodiment, the excavator comprises a pneumatic or hydraulic cylinder, a first end of which is coupled to the vehicle frame and a second end of which is coupled to the swing boom, the cylinder being configured to extend and to rotate the swing boom based on a level of extension.

In a further embodiment, the second measuring sensor is an inertial measurement unit (IMU), wherein the IMU comprises at least one accelerometer and at least one gyroscope.

In a further embodiment, the system is configured to self-calibrate based on a self-calibration procedure including the steps:

- placement of the excavator on a slope, wherein the slope has at least five degrees,
- determination of a gravitational acceleration of the swing boom relative to the slope by the accelerometer of the second measuring sensor,
- extension of the cylinder to a maximum or a minimum level of extension,
- movement of the swing boom to a first position, wherein the first position corresponds to the maximum or the minimum extension level of the cylinder,
- determination of the swing boom angle at the first position based on the gravitational acceleration of the swing boom relative to the slope,
- movement of the swing boom to a second position, wherein the second position corresponds to the maximum or the minimum extension level of the cylinder opposed to the extension level of the cylinder at the first position,
- determination of the swing boom angle at the second position based on the gravitational acceleration of the swing boom relative to the slope,
- movement of the swing boom to a third position, wherein at the third position the first measuring sensor determines an intermittent first interim swing boom angle relative to the vehicle frame, determination of the swing boom angle at the third position based on the gravitational acceleration of the swing boom relative to the slope, determination of a range of motion of the swing boom and the position of the first measuring sensor based on the determined swing boom angles at the first, the second and the third position.

In other words, if an external momentary sensor is mounted on the machine to measure the swing boom angle there is the need to calibrate the position of the sensor relative to the geometry of the machine. While it is possible to attempt to measure the mounting geometry, it is more accurate and simpler on operators to provide an automatic calibration routine that uses existing sensors to calibrate the swing boom measurement. In order to correctly resolve the position of the swing boom with respect to the cab, three positions must be calibrated: the left extreme of swing boom motion, the right extreme of swing boom motion, and the swing boom position corresponding to the sensor.

In a further embodiment, the system is configured to self-calibrate based on a self-calibration procedure including the steps:

movement of the swing boom to a first position, wherein the first position corresponds to a maximum or a minimum extension level of the cylinder, movement of the swing boom to a second position, wherein the second position corresponds to the maximum or the minimum extension level of the cylinder opposed to the extension level of the cylinder at the first position, movement of the swing boom from the second position back to the first position, recording of measurements from the first and the second measuring sensors during the movement of the swing boom, recording of measurement timings from the first measuring sensor during the movement of the swing boom, determination of a range of motion of the swing boom and the position of the first measuring sensor based on the recorded measurements from the second measuring sensor and the measurement timings from the first measuring sensor.

In a further embodiment, the system further comprises a global position sensor configured to be mounted on the swing boom, wherein the global position sensor provides a position measurement of the swing boom in a global reference frame.

In a further embodiment, the system is configured to self-calibrate based on a self-calibration procedure including the steps:

movement of the swing boom to a first position, wherein the first position corresponds to a maximum or a minimum extension level of the cylinder, determination of an exact first position of the swing boom at the first position with the global position sensor, movement of the swing boom to a second position, wherein the second position corresponds to the maximum or the minimum extension level of the cylinder opposed to the extension level of the cylinder at the first position, determination of an exact second position of the swing boom at the second position with the global position sensor, movement of the swing boom to a third position, wherein at the third position the first measuring sensor determines an intermittent first interim swing boom angle relative to the vehicle frame, determination of an exact third position of the swing boom at the third position with the global position sensor, calculation of a rotation axis position based on the determined exact first, second and third positions expressed in a global reference frame, calculation of a first swing boom angle defined by the first and second position, calculation of a second swing boom angle defined by the first and third position, calculation of a third swing boom angle defined by the third and second position, determination of a position of at least one point on the vehicle frame with the global position sensor, conversion of the calculated first, second and third swing boom angles based on the position determinations with the global position sensor into swing boom angles relative to the vehicle frame, wherein the conversion is based on the calculated rotation axis position and the position of at least one point on the vehicle frame.

In other words, calibrating the swing boom motion requires additional measurements of the system. One means of obtaining these measurements is a manual measurement campaign, where the machine is physically measured by hand or using electronic tools and those values are manually or automatically read into the software. These calibration schemes can be quite labor intensive. A preferred method is an automatic calibration procedure that adds context to sensor measurements in order to determine the machine geometry. One such scheme will be detailed below. The calibration scheme makes use of a calibration activity called benching. This action is used often in 2D grade control systems and consists of touching the tip of the bucket to a known point in the environment, called a bench point. In 2D grade control applications a bench point is used primarily to provide a common height reference. Here, a bench point will be used to provide a common position from which the geometry of the machine can be calculated.

BRIEF DESCRIPTION OF THE DRAWINGS

Aspects are illustrated in more detail below, purely by way of example, with reference to working examples shown schematically in the drawing. Identical elements are labelled with the same reference numerals in the figures. The described embodiments are generally not shown true to scale and they are also not to be interpreted as limiting.

DETAILED DESCRIPTION

Figure 1:
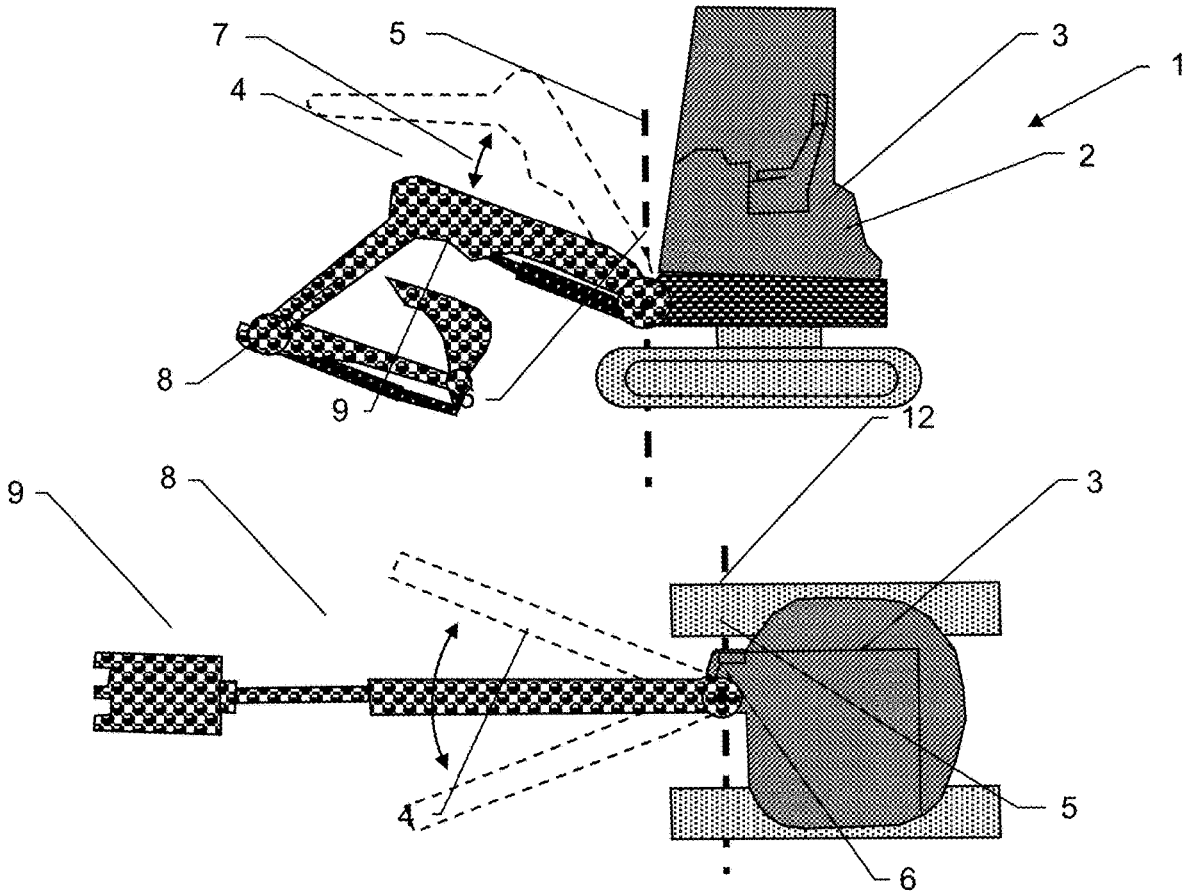
FIG. 1 shows a schematic illustration of the excavator in side view and from above.

FIG. 1 shows a schematic illustration of the excavator 1 in side view and from above to illustrate the individual components of the excavator 1. The excavator 1 comprises a vehicle frame 2 with a cabin 3 and a swing boom 4. The swing boom 4 is arranged on the vehicle frame 2 and can be rotated relative to the vehicle frame 2 about a vertical rotation axis 5 (this degree of freedom determines the swing boom angle $\theta_{SwingBoom}$). It is also possible to rotate the swing boom 4 about a horizontal rotation axis 6 to raise or lower the swing boom 4 (this degree of freedom determines the so called elevation/boom angle 7). In the example shown, an arm 8 and a bucket 9 are attached to the swing boom 4 which can also be moved via horizontal rotation axis. These horizontal rotation axis are parallel to the rotation axis 6.

Figure 2:
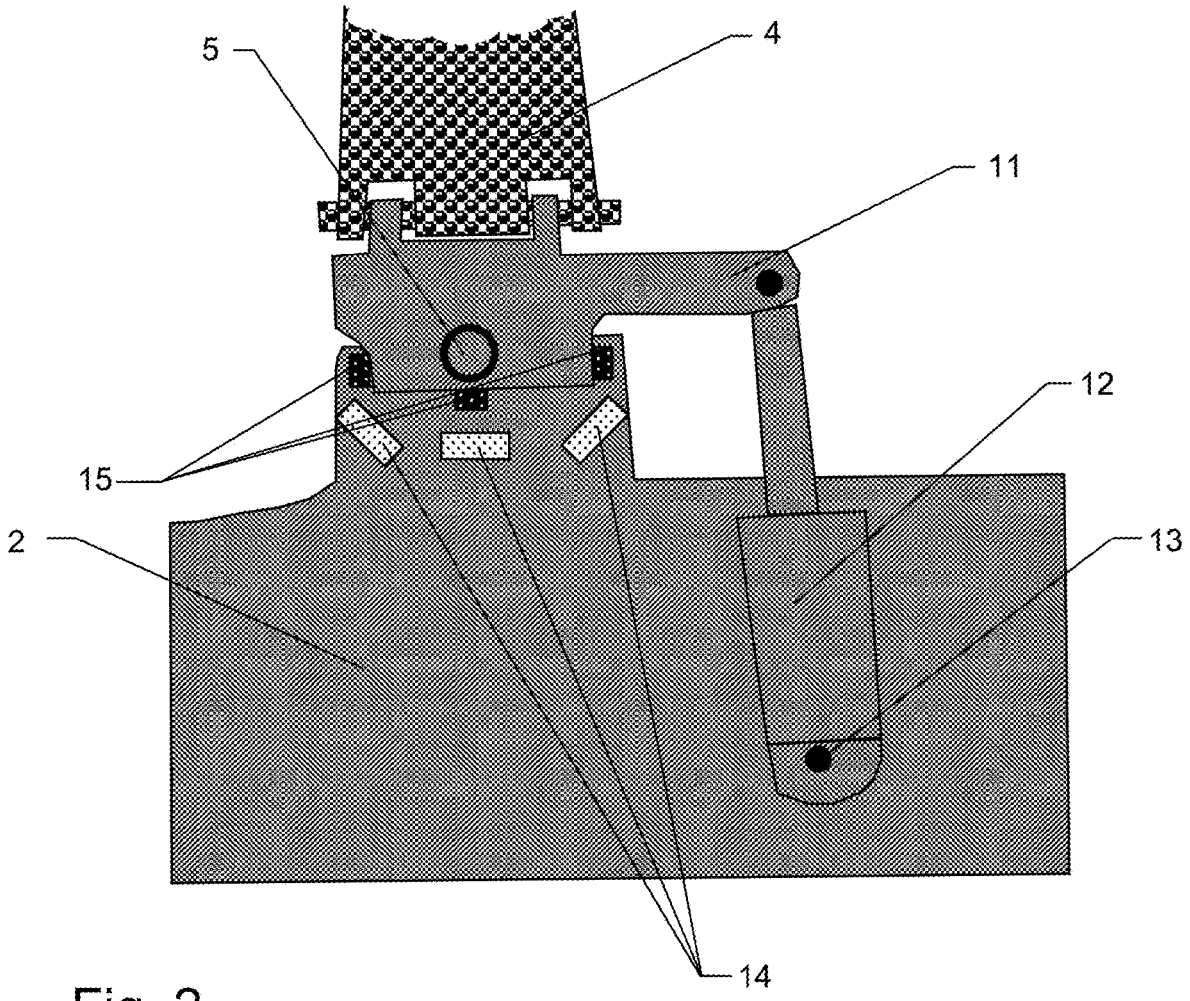
FIG. 2 shows a schematic illustration of a first example for the first measuring sensor mounted on the swing boom joint.

FIG. 2 shows a schematic illustration of a first example for the first measuring sensor 10 mounted on the swing boom joint 11. A top-down view of the joint 11 that connects the swing boom 4 to the vehicle frame 2 is shown. The joint 11 and thus the swing boom 4 can rotate around the vertical axis of rotation 5. This rotation is initiated by a hydraulic or pneumatic cylinder 12, which can itself rotate around another vertical axis 13 and lengthen (counterclockwise rotation) or shorten (clockwise rotation) during the rotation, thus turning the joint 11 in the corresponding direction. In this example, three Hall effect sensors 14 are attached to the vehicle frame 2 as first measuring sensors 10 and three magnets 15 are attached to the joint 11 as counterparts. If the joint 11 and thus the swing boom 4 rotates, the magnets 15 move according to the direction of rotation of the swing boom 4. If a magnet 15 moves past a Hall sensor 14, this is detected by the sensor 14. Since the position of the magnets 15 on the swing boom 4 and the positions of the Hall sensors 14 on the vehicle frame 2 are known, the exact position of the swing boom 4 relative to the vehicle frame 2 can be determined by the processing unit.

Figure 3:
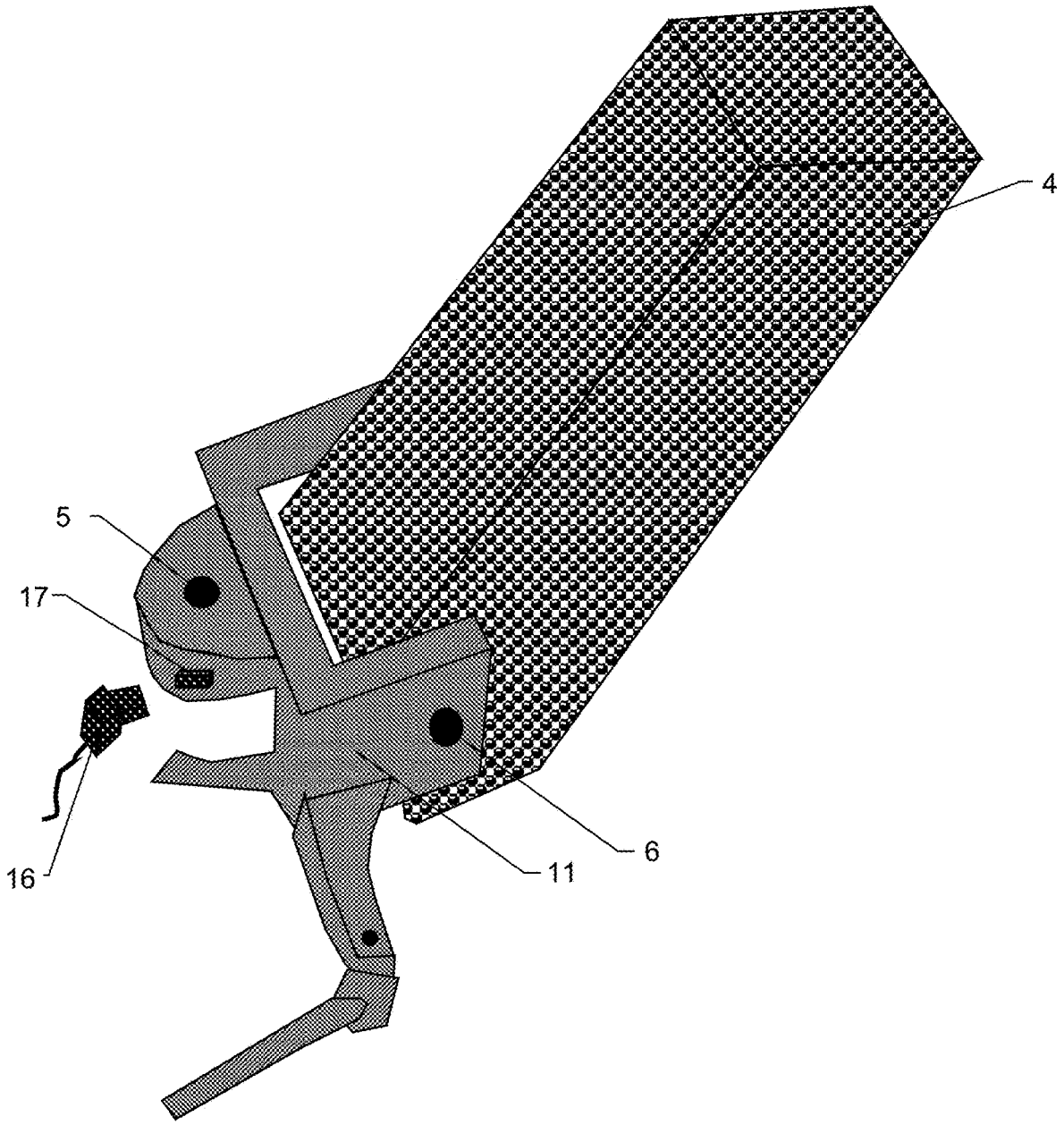
FIG. 3 shows a schematic illustration of a second example for the first measuring sensor mounted on the swing boom joint.

FIG. 3 shows a schematic illustration of a second example for the first measuring sensor 10 mounted on the swing boom joint 11. Based on this joint 11 the swing boom 4 is attached to the vehicle frame 2 and can rotate around the vertical rotation axis 5. Line of sight sensors 16 (ultrasonic, induction, lidar, radar, etc) can be used as first measuring sensors 10 to measure swing boom angle in a simple manner. A small prism 17 of metal can be welded, epoxy mounted, magnet mounted, or screwed into to the casting between the vehicle frame 2 structure and the swing boom structure (joint) 11 as shown in FIG. 3. The prism 17 should be designed with surface features that can be detected by the sensor 16. In the simplest case this can be a small cubic or rectangular prism. If the installation allows, holes could be drilled and tapped, and bolts inserted so that the sensors could detect the bolt heads.

Figure 4:
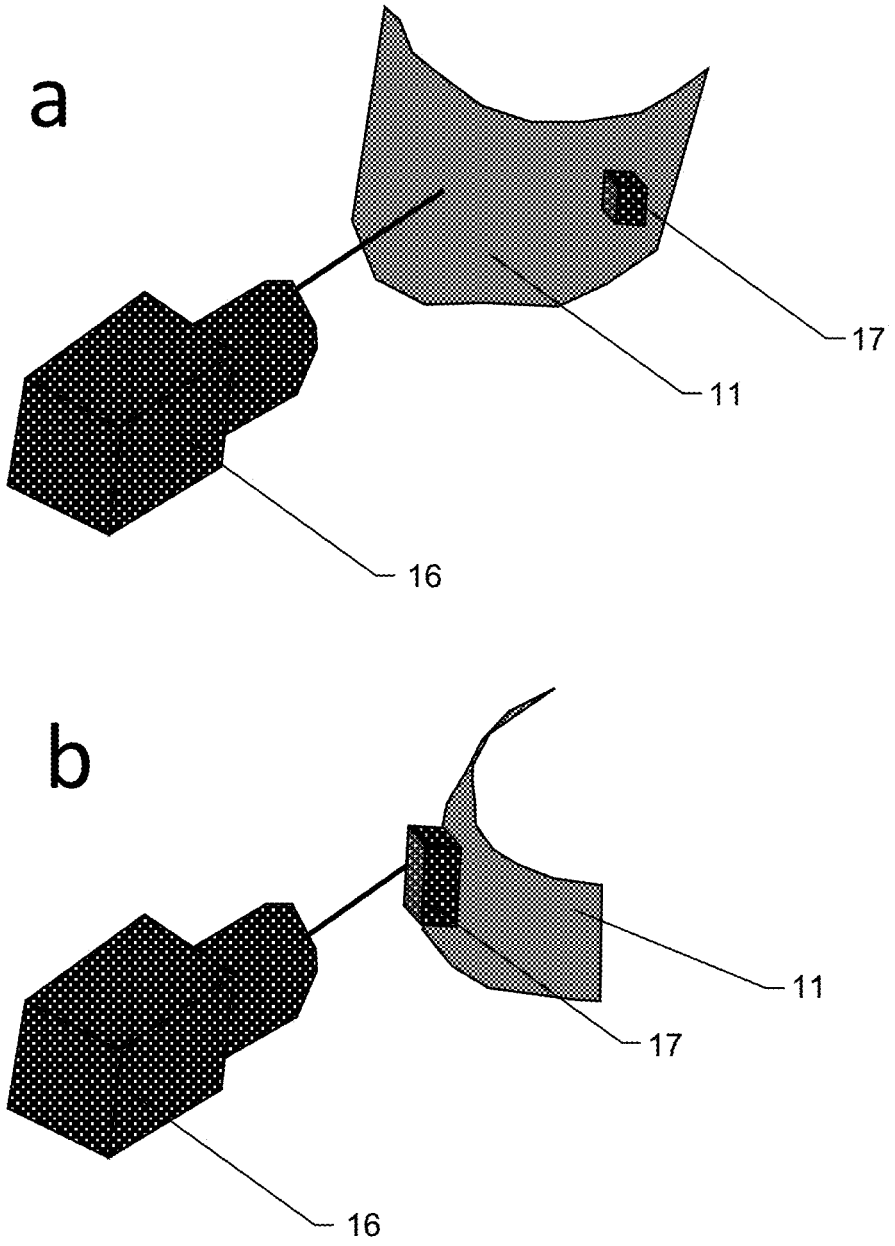
FIG. 4 shows a schematic illustration of the logical responses to presence/absence of features that can be detected by the first measuring sensor.

FIG. 4 shows a schematic illustration of the logical responses to presence/absence of features that can be detected by the first measuring sensor 10. During most of the motion, the prism 17 will not be present in front of the sensor 16 (used as first measuring sensor 10). The sensor 16 is configured so that it returns a "logical false" signal to indicate that the prism 17 is absent from the sensing zone (FIG. 4*a*). When the rotation of the swing boom casting presents the prism to the sensing zone, the sensor 16 will see that the flat face of the prism 17 is closer than the background structure. The sensor will be configured so that it returns a "logical true" signal to indicate that the prism 17 is present in the sensing zone (FIG. 4*b*).

Figure 5:
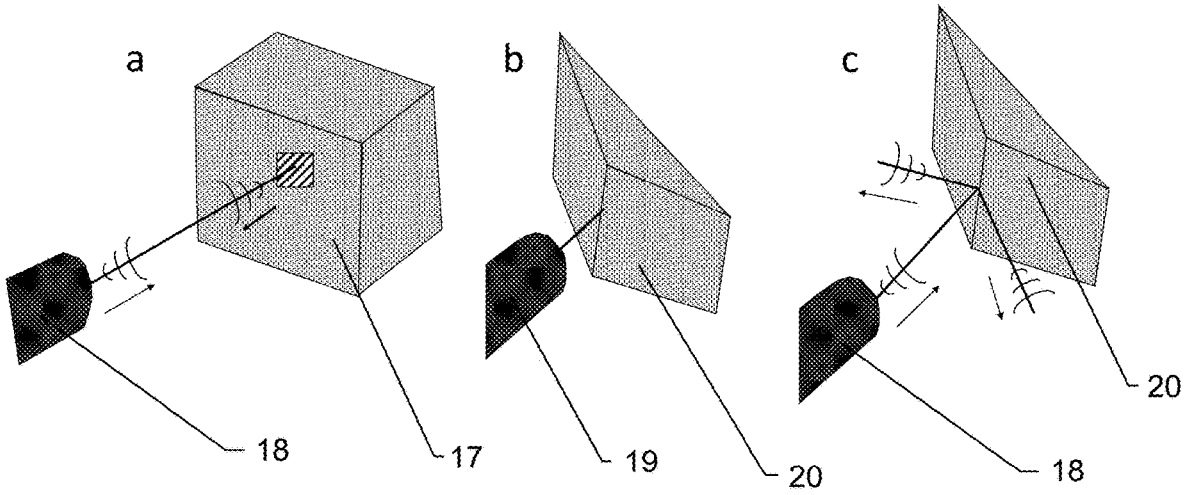
FIG. 5 shows a schematic illustration of different prism orientations for ultrasonic and induction sensors.

FIG. 5 shows a schematic illustration of different prism orientations for ultrasonic and induction sensors. If an ultrasonic sensor 18 is used, then the prism 17 should be oriented so that the flat face is normal to the measurement direction and the sound waves hit the surface and are reflected directly towards the ultrasonic sensor 18 (FIG. 5*a*). This will generate a small region that returns as positive and some transition region near the edges of the prism 17. The prism 17 should either be small enough that a positive return is only received for a very small angular region or large enough that the leading and receding edges of the prism can be distinctly identified using the power of the ultrasonic return.

The ultrasonic configuration is also suitable for use with an induction sensor 19. However, a triangular prism 20 may also be used with induction sensors 19 (FIG. 5*b*). In this case a sharp edge is presented so that the distance measured by the induction sensor 19 has a sharp peak with respect to the angular rotation of the swing boom 4. The threshold value for a "logical true" return can then be tuned to the geometry. However, the edge geometry suitable for induction sensors is not suitable for ultrasonic sensors 18 as the sound wave may be diverted by the angled surfaces so that most of the energy is sent away from the sensor 18 rather than back towards the sensor 18 (FIG. 5*c*).

Figure 6:
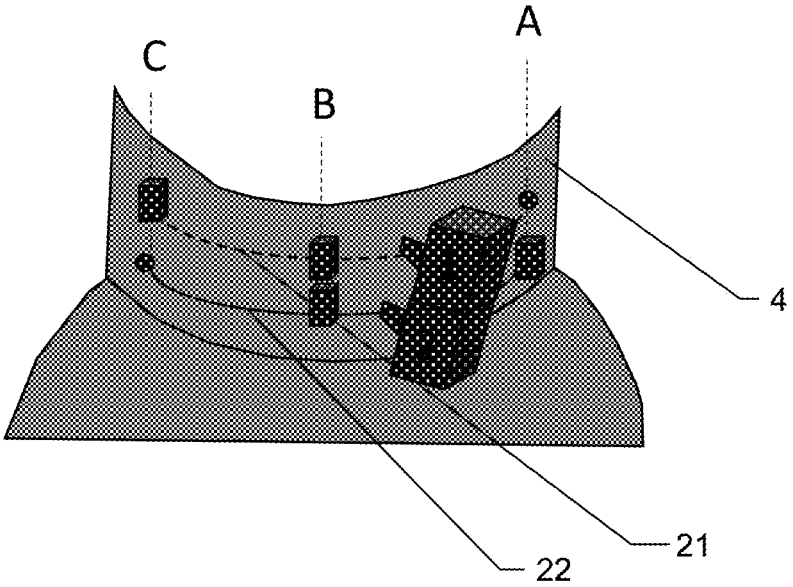
FIG. 6 shows a schematic illustration of a measuring system based on multiple sensors for bitwise encoding of the detected position.

FIG. 6 shows a schematic illustration of a measuring system based on multiple sensors for bitwise encoding of the detected position. Several sensors can be used to encode a multitude of positions in a deterministic way. Two sensors have been mounted at a single location, configured vertically. The sensors read arcs on the structure, denoted with dashed lines 21, 22. Measurements are desired at three positions on the swing boom structure 4, positions A, B, and C. A prism is located on the upper arc at positions B and C and a prism is located on the lower arc at positions A and B.

When both sensors return "logical false" then the sensor array does not provide any information about the swing boom angle. When "logical true" values are returned then the combination of sensor readings can be used to determine the swing boom angular position according to the following truth table. Although this example shows a 3 position encoding with 2 bits, this idea may be extended to N bits which encode 2N−1 positions. Note that there is a unique integer encoding for each of the sensed positions with zero corresponding to "unknown location".

| | Other | A | B | C |
|---|---|---|---|---|
| Sensor 1 Response | 0 | 0 | 1 | 1 |
| Sensor 2 Response | 0 | 1 | 1 | 0 |
| Integer Encoding | 0 | 1 | 3 | 2 |

Figure 7:
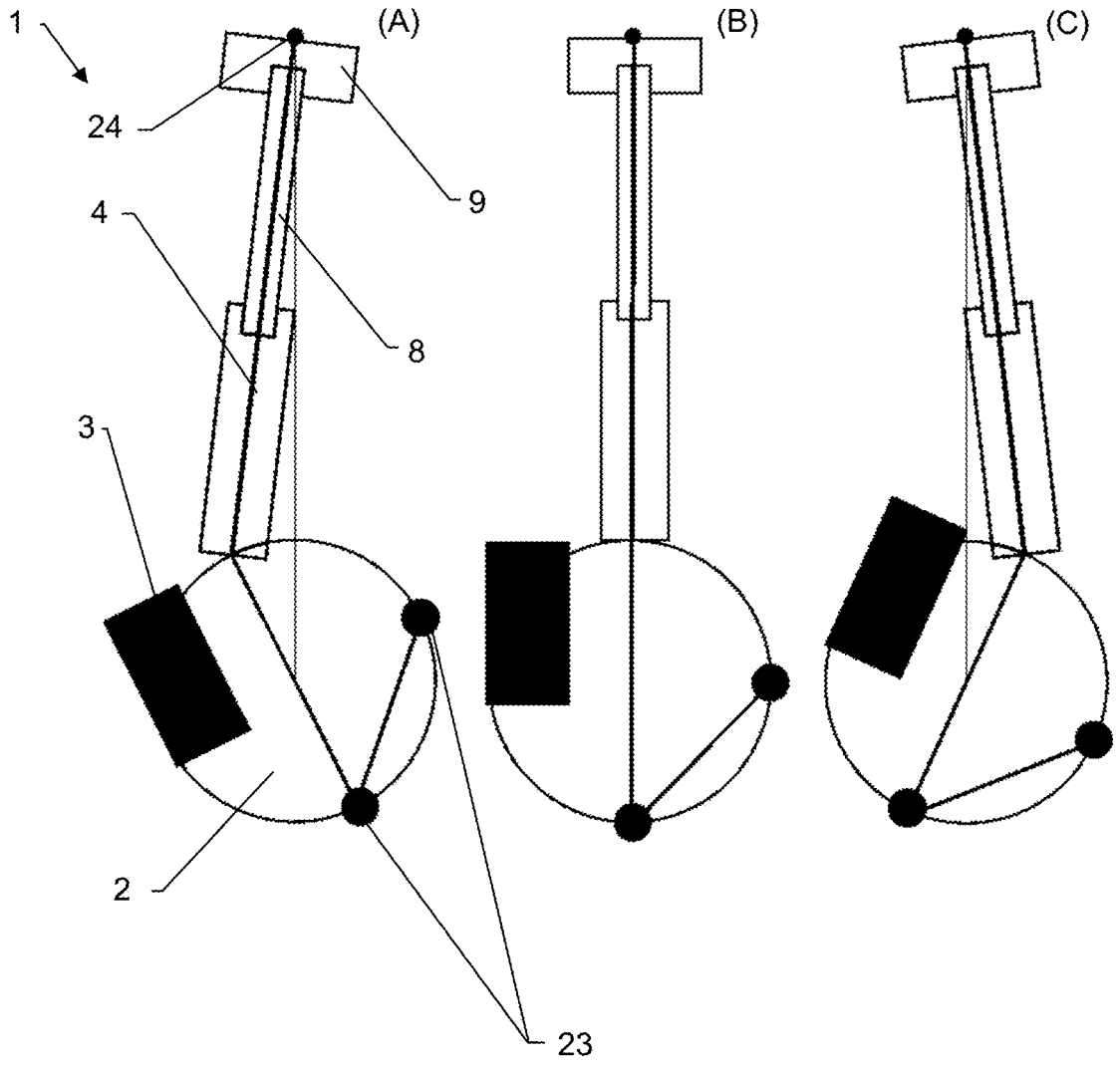
FIG. 7 shows a schematic illustration of the excavator from above including a fixed bench point used as a reference point for the bucket.

FIG. 7 shows a schematic illustration of the excavator 1 from above (in this particular example a mini excavator with a rotating upper part) including the dig structure (swing boom 4, arm 8 and bucket 9), the operator cabin 3, two GNSS antennas 23 on the rotating upper part (vehicle frame 2), and a fixed bench point 24 used as a reference point for the bucket 9. If the tracks are not moved between these poses, then the center of rotation of the upper part (cabin) structure is located at the same point in space in all three poses (A, B, C). If the center of the bucket 9 is benched to the fixed marker 24 on the ground, then the center of the bucket 9 is also located at the same point in space in all three poses (A, B, C). The dual GNSS antennas 23 mounted on the rotating upper part 2 enable the measurement of the orientation of the cabin 3 in space. Combining that with the manufacturing geometry of the excavator 1, three triangles can be constructed and overlayed for this geometry.

Figure 8:
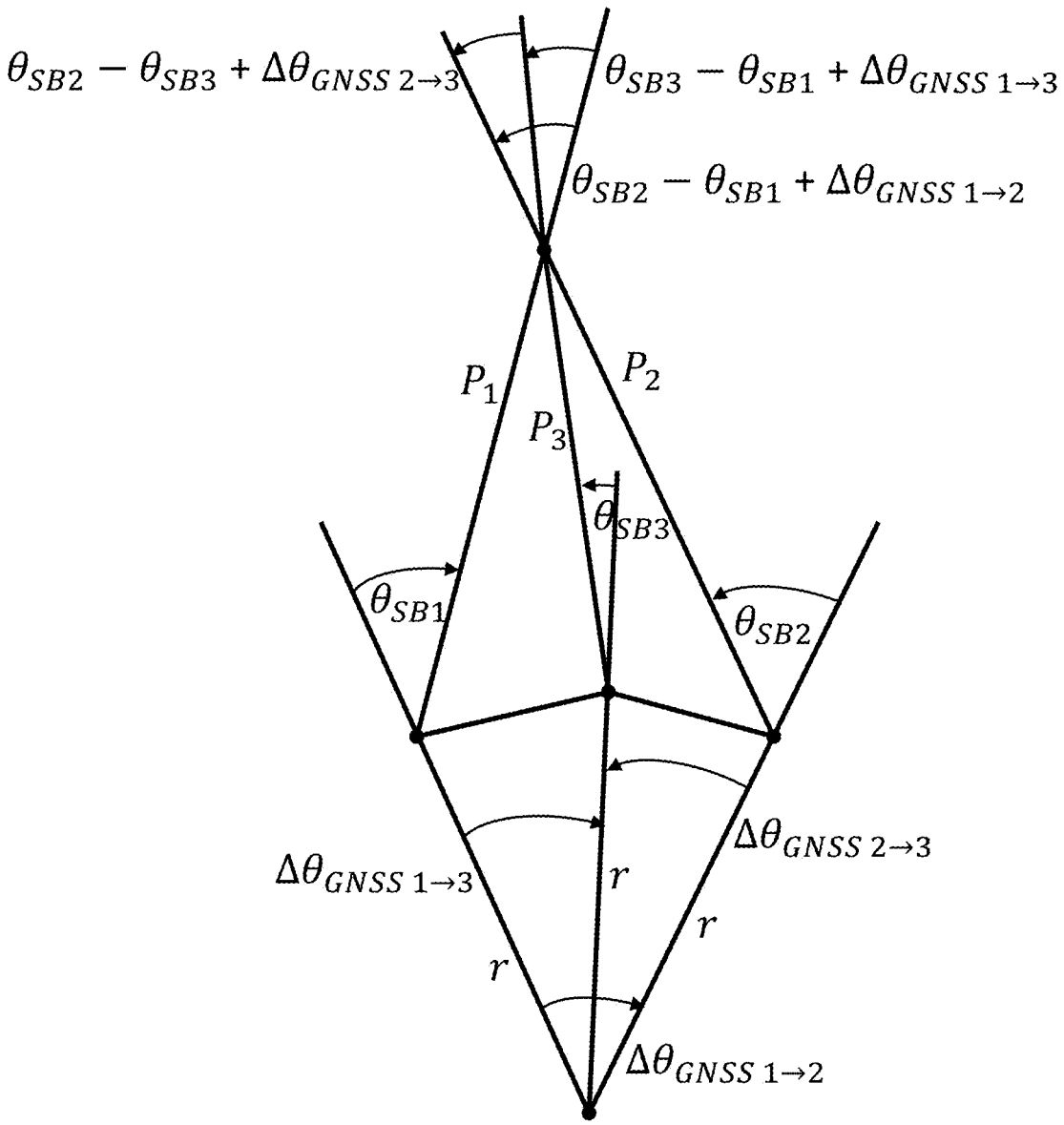
FIG. 8 shows a simplified representation of how three poses can be overlayed to solve for the manufacturing geometry of the excavator.

FIG. 8 shows a simplified representation of how these three poses (A, B, C) can be overlayed to solve for the manufacturing geometry of the excavator. In position 1, the excavator swings left (in this particular example the rotatable upper part of a mini excavator swings left) and the boom swings right (pose A). In position 2 the excavator swings right (in this particular example the rotatable upper part of a mini excavator swings right) and the swing boom swings left (pose C). In position 3, the excavator is oriented so that the intermittent sensor returns positive (pose B). The distance r is known from the manufacturing geometry for the machine components and can be related to the GNSS using the mounting geometry of the antenna array. The GNSS antennas allow the calculation of the three angular displacements between $\Delta\theta_{GNSS1\to2}$, $\Delta\theta_{GNSS2\to3}$, and $\Delta\theta_{GNSS1\to3}$, between positions 1 and 2, 2 and 3, and 1 and 3, respectively.

The reach distances, $P_1$, $P_2$, and $P_3$, are calculated from the excavator pose measured each time the excavator is benched. In order to calculate the two swing boom angles $\theta_{SB1}$, $\theta_{SB2}$, trigonometry can be applied along with the law of cosines to arrive at:

$$\theta_{SB1} = \frac{\pi + \theta_{GNSS1\to2}}{2} - \cos^{-1}\left(\frac{\rho_1^2 + 4r^2\sin^2\left(\frac{\theta_{GNSS1\to2}}{2}\right) - \rho_2^2}{4\rho_1 r\sin\left(\frac{\theta_{GNSS1\to2}}{2}\right)}\right)$$

$$\theta_{SB2} = \frac{\pi + \theta_{GNSS1\to2}}{2} - \cos^{-1}\left(\frac{\rho_2^2 + 4r^2\sin^2\left(\frac{\theta_{GNSS1\to2}}{2}\right) - \rho_1^2}{4\rho_2 r\sin\left(\frac{\theta_{GNSS1\to2}}{2}\right)}\right)$$

The same method can be applied to find position 3, replacing either position with position 3. This provides the swing boom angle for the leftmost position (position 1), the rightmost position (position 2), and the calibration position (position 3) where the discrete sensor returns a logical "true". If the gyro integration accuracy is sufficient over the time required to position the excavator, this procedure can also be executed using a gyro integration to measure the change in angle between positions in place of the GNSS measurement. The resulting accuracy will depend on the quality of the gyroscopes and the duration of the test.

Figure 9:
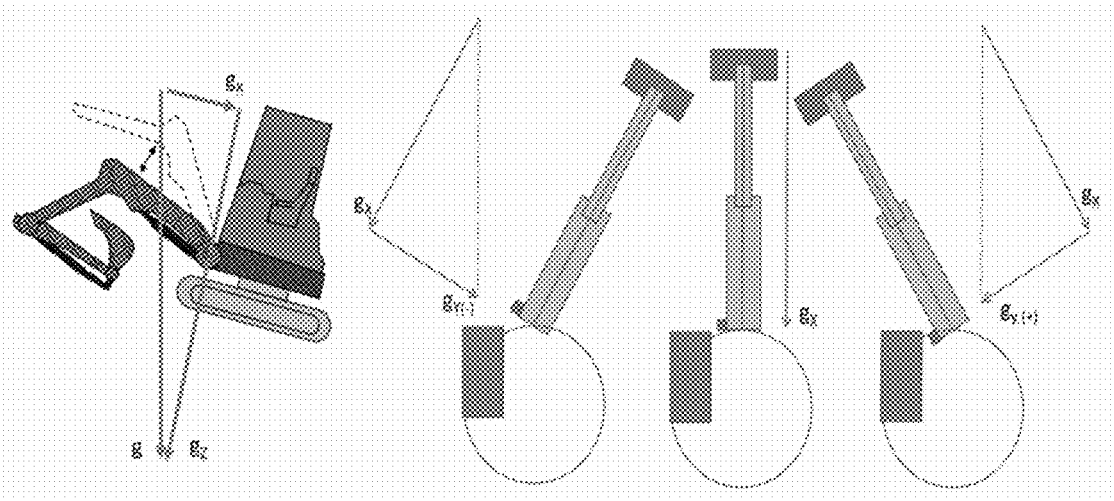
FIG. 9 shows an example for a swing boom sensor placement geometry with accelerometer measurements.

FIG. 9 shows an example for a swing boom sensor placement geometry with accelerometer measurements. Just as the GNSS baseline provides additional measurements and machine context that can be used to determine the angle of the swing boom sensor, the accelerometer on the swing boom itself can be used to confirm the sensor mounting. The geometry of the solution using accelerometer measurements of the swing center is shown in FIG. 9. Since the machine is sitting on a slope, there is a component of gravity along the fore-aft machine direction. As the swing boom is rotated, the accelerometer on the swing boom will measure a change in direction of the sensor relative to the direction of the slope. This can be used to calculate the change in direction of the swing boom. If there is a second accelerometer placed on the upper cab of the machine, the direction of the acceleration measured by the swing boom accelerometer can be compared to the direction of the acceleration measured by the cab accelerometer in order to determine the orientation of the swing boom relative to the cab regardless of the orientation of the upper cab relative to the slope direction. It is trivial for a skilled person (e.g. someone who works with accelerometers) to determine how to calculate the swing boom angle from FIG. 9.

Figure 10:
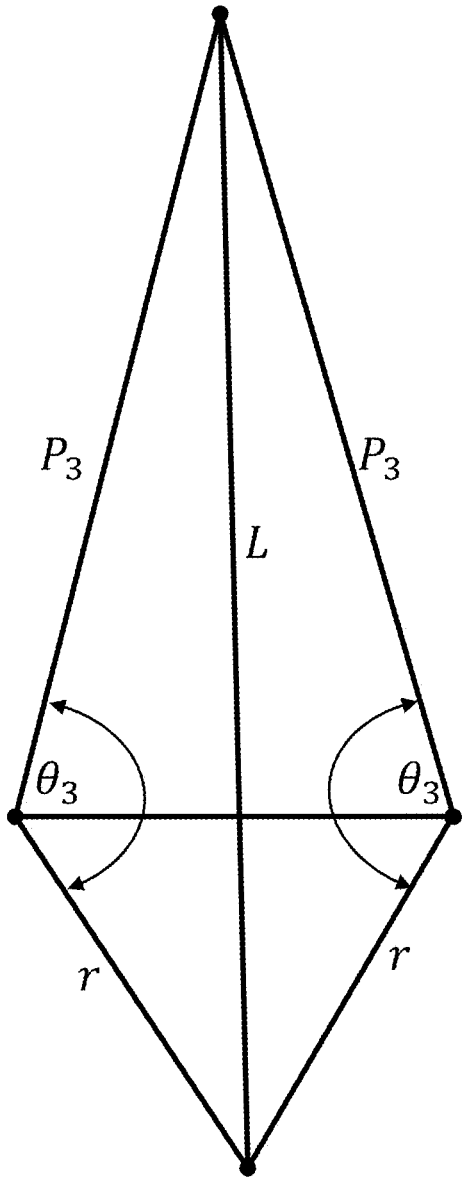
FIG. 10 shows a schematic illustration of the double value problem.

One of the challenges in an automatic calibration is shown in FIG. 10 as the double value problem. As the swing boom angle moves out of the centered position there are two geometric solutions which correspond to a right and left swing boom displacement. If the momentary sensor (first measuring sensor) is placed near the centered position then sensor noise in the GNSS or accelerometer measurements may incorrectly identify the direction of the swing boom displacement. This can be identified and resolved using a dynamic test. The following test should be performed starting at each of the extreme swing boom positions.

1. Position the swing boom 4 at the extreme position (the position corresponds to a maximum or a minimum extension level of the cylinder 12).
2. Continuously and smoothly rotate the swing boom 4 through the sensor position to the opposite extreme position while logging gyroscope data.
3. Integrate the gyroscope data from the start of motion until the instant the sensor responded.
4. Compare the integrated swing boom displacement to the angular displacement between the calculated extreme position and sensor mounting position.
5. If the displacements are inconsistent, check for consistency between the integrated displacement and the displacement between the calculated extreme position and the sensor mounting position if the opposing direction is assumed. If this solution is consistent flag the sensor mounting position as having the incorrect sign and test from the opposite extreme.
6. If neither solution is consistent flag the calibration as inconsistent.

If neither of these tests flags the calculated sensor position as having the wrong sign or flags the calibration as being inconsistent, then the solution can be assumed to be correct. If both of these tests flag the calculated sensor as having the wrong sign and neither test flags the calibration as being inconsistent, then the sensor mounting position can be assumed to be correct once the direction is reversed. If only one of the tests flags the calculated sensor position as having the wrong sign or either of the tests flags the calibration as inconsistent, the calibration should be assumed to have inconsistent data due to sensor noise and the calibration should be discarded and repeated.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A system for determining a swing boom angle of an excavator, wherein the excavator comprises:

a vehicle frame comprising a cabin, a swing boom arranged on the vehicle frame and configured to be rotated relative to the vehicle frame about a vertical rotation axis that an actual swing boom position defines a swing boom angle, wherein the vertical rotation axis is a vertical axis, wherein the system comprises:

a first measuring sensor configured to be mounted on:

the vehicle frame, or the swing boom, wherein the first measuring sensor is configured to determine a first interim swing boom angle of the swing boom relative to the vehicle frame about the vertical rotation axis, the first interim swing boom angle being one of a discrete amount of one or more intermittent first interim swing boom angles about the vertical rotation axis, each of the discrete amount of one or more intermittent first interim swing boom angles being spaced from each other by at least a value of one degree, a second measuring sensor configured to be mounted on the swing boom and to determine a second interim swing boom angle of the swing boom relative to the vehicle frame about the vertical rotation axis, the second interim swing boom angle being from an indiscrete angle range, a processing unit configured to:

receive the first interim swing boom angle and the second interim swing boom angle about the vertical rotation axis, and determine the swing boom angle by applying at least one of a filter and an algorithm to the first interim swing boom angle and the second interim swing boom angle about the vertical rotation axis.

2. The system according to claim 1, wherein the system further comprises a display unit configured to be arranged in the cabin, wherein the display unit is connected to the processing unit, the display unit being configured to provide a visualization of swing boom angle information to the operator based on the swing boom angle.

3. The system according to claim 2, wherein the system is configured to self-calibrate based on a self-calibration procedure including the steps:

movement of the swing boom to a first position, wherein the first position corresponds to a maximum or a minimum extension level of the cylinder, movement of the swing boom to a second position, wherein the second position corresponds to the maximum or the minimum extension level of the cylinder opposed to the extension level of the cylinder at the first position, movement of the swing boom from the second position back to the first position, recording of measurements from the first and the second measuring sensors during the movement of the swing boom, recording of measurement timings from the first measuring sensor during the movement of the swing boom, determination of a range of motion of the swing boom and the position of the first measuring sensor based on the recorded measurements from the second measuring sensor and the measurement timings from the first measuring sensor.

4. The system according to claim 3, wherein the system further comprises a global position sensor configured to be mounted on the swing boom, wherein the global position sensor provides a position measurement of the swing boom in a global reference frame.

5. The system according to claim 3, the system is configured to self-calibrate based on a self-calibration procedure including the steps:

movement of the swing boom to a first position, wherein the first position corresponds to a maximum or a minimum extension level of the cylinder, determination of an exact first position of the swing boom at the first position with the global position sensor, movement of the swing boom to a second position, wherein the second position corresponds to the maximum or the minimum extension level of the cylinder opposed to the extension level of the cylinder at the first position, determination of an exact second position of the swing boom at the second position with the global position sensor, movement of the swing boom to a third position, wherein at the third position the first measuring sensor determines an intermittent first interim swing boom angle relative to the vehicle frame, determination of an exact third position of the swing boom at the third position with the global position sensor, calculation of a rotation axis position based on the determined exact first, second and third positions expressed in a global reference frame, calculation of a first swing boom angle defined by the first and second position, calculation of a second swing boom angle defined by the first and third position, calculation of a third swing boom angle defined by the third and second position, determination of a position of at least one point on the vehicle frame with the global position sensor, conversion of the calculated first, second and third swing boom angles based on the position determinations with the global position sensor into swing boom angles relative to the vehicle frame, wherein the conversion is based on the calculated rotation axis position and the position of at least one point on the vehicle frame.

6. The system according to claim 1, further comprising a counterpart intended for detection by the first measuring sensor, wherein the counterpart:

is configured to be mounted on the swing boom and to move along with the swing movement of the swing boom if the first measuring sensor is mounted on the vehicle frame, or is configured to be mounted on the vehicle frame at a known position if the first measuring sensor is mounted on the swing boom to move along with the swing movement of the swing boom.

7. The system according to claim 1, wherein the first measuring sensor is at least one hall effect sensor and the counterpart is at least one magnet.

8. The system according to claim 1, wherein the first measuring sensor is at least one induction sensor and the counterpart is at least one metal structure.

9. The system according to claim 1, wherein the first measuring sensor is at least one light emitting and sensing system and the counterpart is at least one reflector.

10. The system according to claim 1, wherein the first measuring sensor is at least one momentary switch and the counterpart is at least one metal structure, wherein the at least one metal structure physically contacts the at least one switch and triggers the at least one switch.

11. The system according to claim 1, wherein the first measuring sensor is at least one visual sensor configured to detect colors and the counterpart is a color gradient.

12. The system according to claim 1, wherein the excavator comprises a pneumatic or hydraulic cylinder, a first end of which is coupled to the vehicle frame and a second end of which is coupled to the swing boom, the cylinder being configured to extend and to rotate the swing boom based on a level of extension.

13. The system according to claim 1, wherein the second measuring sensor is an inertial measurement unit (IMU) having at least one accelerometer and at least one gyroscope.

14. The system according to claim 1, wherein the system is configured to self-calibrate based on a self-calibration procedure including the steps:

placement of the excavator on a slope, wherein the slope has at least five degrees, determination of a gravitational acceleration of the swing boom relative to the slope by the accelerometer of the second measuring sensor, extension of the cylinder to a maximum or a minimum level of extension, movement of the swing boom to a first position, wherein the first position corresponds to the maximum or the minimum extension level of the cylinder, determination of the swing boom angle at the first position based on the gravitational acceleration of the swing boom relative to the slope, movement of the swing boom to a second position, wherein the second position corresponds to the maximum or the minimum extension level of the cylinder opposed to the extension level of the cylinder at the first position, determination of the swing boom angle at the second position based on the gravitational acceleration of the swing boom relative to the slope, movement of the swing boom to a third position, wherein at the third position the first measuring sensor determines an intermittent first interim swing boom angle relative to the vehicle frame, determination of the swing boom angle at the third position based on the gravitational acceleration of the swing boom relative to the slope, determination of a range of motion of the swing boom and the position of the first measuring sensor based on the determined swing boom angles at the first, the second and the third position.

15. The system according to claim 1, wherein the system is configured to self-calibrate based on a self-calibration procedure including the steps:

movement of the swing boom to a first position, wherein the first position corresponds to a maximum or a minimum extension level of the cylinder, movement of the swing boom to a second position, wherein the second position corresponds to the maximum or the minimum extension level of the cylinder opposed to the extension level of the cylinder at the first position, movement of the swing boom from the second position back to the first position, recording of measurements from the first and the second measuring sensors during the movement of the swing boom, recording of measurement timings from the first measuring sensor during the movement of the swing boom, determination of a range of motion of the swing boom and the position of the first measuring sensor based on the recorded measurements from the second measuring sensor and the measurement timings from the first measuring sensor.

16. The system according to claim 1, wherein the system further comprises a global position sensor configured to be mounted on the swing boom, wherein the global position sensor provides a position measurement of the swing boom in a global reference frame.

17. The system according to claim 1, wherein the first measuring sensor is at least one hall effect sensor and the counterpart includes at least one permanent magnet or at least one electro magnet.

18. The system according to claim 1, wherein the first measuring sensor is at least one light emitting and sensing system and the counterpart includes at least one mirror.

* * * * *